US012492852B2

(12) United States Patent
Kuppuswamy et al.

(10) Patent No.: US 12,492,852 B2
(45) Date of Patent: Dec. 9, 2025

(54) REFRIGERATION SYSTEM WITH AN OIL DRAIN CONDUIT AND METHODS OF USE

(71) Applicant: Heatcraft Refrigeration Products LLC, Stone Mountain, GA (US)

(72) Inventors: Janakiraman Kuppuswamy, Decatur, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 198 days.

(21) Appl. No.: 18/514,312

(22) Filed: Nov. 20, 2023

(65) Prior Publication Data

US 2025/0164166 A1 May 22, 2025

(51) Int. Cl.

| | |
|---|---|
| ***F25B 45/00*** | (2006.01) |
| ***F25B 31/00*** | (2006.01) |
| ***F25B 41/20*** | (2021.01) |

(52) U.S. Cl.

CPC ..... *F25B 45/00* (2013.01); *F25B 31/002* (2013.01); *F25B 41/20* (2021.01); *F25B 2345/002* (2013.01)

(58) Field of Classification Search

CPC .. F25B 2400/075; F25B 43/02; F25B 31/004; F25B 2345/002; F25B 41/20; F25B 31/002; F25B 45/00

See application file for complete search history.

(56) References Cited

FOREIGN PATENT DOCUMENTS

DE 102015121583 A1 * 6/2017 ..... F25B 43/02
DE 102018113333 A1 * 12/2019 ..... F28F 9/0204

* cited by examiner

*Primary Examiner* — Ana M Vazquez
(74) *Attorney, Agent, or Firm* — Baker Botts L.L.P.

(57) ABSTRACT

A refrigeration system includes a low side heat exchanger configured to receive a first portion of a working fluid from a flash tank. The refrigeration system further includes a header positioned downstream of the low side heat exchanger, wherein the header has one or more inlets configured to receive the working fluid from the low side heat exchanger, a first outlet, and a second outlet. The refrigeration system further includes a check valve positioned downstream of the first outlet, a compressor positioned downstream of the check valve, and an oil drain conduit. The oil drain conduit has an inlet in fluid communication with the second outlet of the header. The drain conduit has an outlet configured to discharge at least a portion of the working fluid to a position downstream of the check valve and upstream of the compressor.

20 Claims, 4 Drawing Sheets

REFRIGERATION SYSTEM WITH AN OIL DRAIN CONDUIT AND METHODS OF USE

TECHNICAL FIELD

This disclosure relates generally to refrigeration systems. More particularly, this disclosure relates to a refrigeration system with an oil drain conduit and methods of use.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY

The systems and methods in the present disclosure provide practical applications and technical advantages that overcome the current technical problems described herein. In certain instances, oil from various sources in refrigeration systems, such as compressors, may accumulate in the refrigerant and build up in heat exchanger coils and conduits surrounding the heat exchanger unit. The presence of oil in the heat exchanger coils reduces heat transfer efficiency and increases the total energy required to operate the system. Additionally, if enough oil accumulates at the outlet of the heat exchanger coils, a suction pressure applied by the compressor during start up conditions may pull the oil into the compressor. This may cause damage to the compressor. Although an oil separator may be included in the refrigeration system to reduce an amount of oil in the circulating refrigerant, oil separators do not operate at one-hundred percent efficiency, and therefore some residual oil remains in the refrigerant.

The provided systems and methods are integrated into the practical application of reducing an amount of oil contaminant in a heat exchanger unit to improve operating efficiency and reduce the total energy required to operate the system. During operation, working fluid that comprises refrigerant and an oil contaminant passes through a heat exchanger of the provided systems and methods and is transferred to a header. The oil contaminant may accumulate towards a bottom surface of the header due to the higher density of the oil relative to the refrigerant. The provided systems and methods may facilitate reducing the amount of oil contaminant in the heat exchanger unit using a check valve and an oil drain conduit. For example, the header may include a first outlet in fluid communication with the check valve and a second outlet in fluid communication with the oil drain conduit. The first outlet of the header is positioned at a height above the second outlet of the header. The oil drain conduit includes an outlet that discharges working fluid to a position located upstream of the check valve and downstream of a compressor. During operation, a differential pressure induced by the check valve and a suction pressure from the compressor positioned downstream of the check valve causes a portion of the working fluid to be suctioned from the header through the oil drain conduit. The suction of the working fluid through the oil drain conduit pulls the oil contaminant along with it and reduces an amount of oil contaminant in the heat exchanger unit, thereby improving operating efficiency and reducing the total energy required to operate the system.

In some embodiments, the present disclosure provides a refrigeration system. The refrigeration system includes a low side heat exchanger configured to receive a working fluid. The low side heat exchange includes one or more circuits of coils, where each of the one or more circuits of coils include a hollow interior configured to receive the working fluid. The one or more circuits of coils are configured to cool a space proximate the low side heat exchanger by transferring heat between airflow passing across an external surface of the one or more circuits of coils and the working fluid passing though the hollow interior of the one or more circuits of coils. The refrigeration system includes a header positioned downstream of the one or more circuits of coils. The header includes one or more inlets configured to receive the working fluid from the one or more circuits of coils. The one or more inlets place the hollow interior of the one or more circuits of coils in fluid communication with a hollow interior of the header. The header includes a first outlet in fluid communication with the hollow interior of the header, and a second outlet in fluid communication with the hollow interior of the header. The refrigeration system includes a check valve positioned downstream of the first outlet. The check valve is configured to allow the working fluid to flow through the check valve when a pressure difference across the check valve exceeds a threshold pressure. The refrigeration system includes a compressor positioned downstream of the check valve, where the compressor is configured to compress the working fluid received from the check valve. The refrigeration system includes an oil drain conduit comprising an inlet in fluid communication with the second outlet of the header. The oil drain conduit comprises an outlet configured to discharge at least a portion of the working fluid to a position downstream of the check valve and upstream of the compressor.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Embodiments of the present disclosure and its advantages are best understood by referring to FIGS. 1-4 of the drawings, like numerals being used for like and corresponding parts of the various drawings.

As described above, in certain instances, oil from various sources in refrigeration systems, such as compressors, may accumulate in the refrigerant and build up in heat exchanger coils and conduits surrounding the heat exchanger unit. The presence of oil in the heat exchanger coils reduces heat transfer efficiency and increases the total energy required to operate the system. Additionally, if enough oil accumulates at the outlet of the heat exchanger coils, a suction pressure applied by the compressor during start up conditions may pull the oil into the compressor. This may cause damage to the compressor.

The provided systems and methods may facilitate reducing the amount of oil contaminant in the heat exchanger unit using a check valve and an oil drain conduit. For example, the header may include a first outlet in fluid communication with the check valve and a second outlet in fluid communication with the oil drain conduit. The first outlet of the header is positioned at a height above the second outlet of the header. The oil drain conduit includes an outlet that discharges working fluid to a position located upstream of the check valve and downstream of a compressor. During operation, a differential pressure induced by the check valve and a suction pressure from the compressor positioned downstream of the check valve causes a portion of the working fluid to be suctioned from the header through the oil drain conduit. The suction of the working fluid through the oil drain conduit pulls the oil contaminant along with it and reduces an amount of oil contaminant in the heat exchanger unit, thereby improving operating efficiency and reducing the total energy required to operate the system.

System Overview

Figure 1:
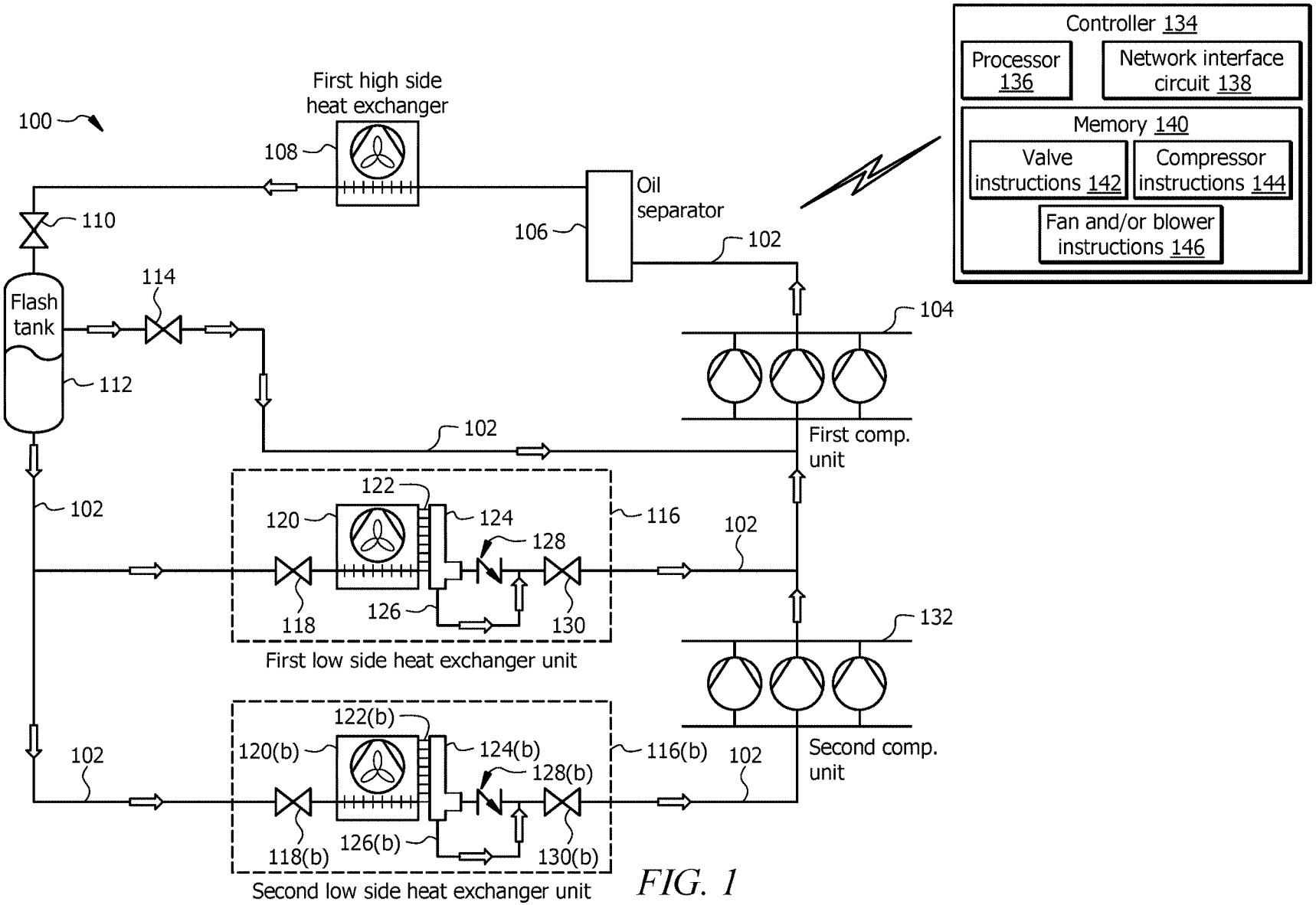
FIG. 1 is a block diagram illustrating an example refrigeration system according to an embodiment of the present disclosure.

FIG. 1 illustrates an example refrigeration system 100 according to various embodiments of the present disclosure. In general, the refrigeration system 100 includes a refrigerant conduit subsystem 102, a first compressor unit 104, an oil separator 106, a first high side heat exchanger 108, a valve 110, a flash tank 112, a flash gas valve 114, a first low side heat exchanger unit 116, a second low side heat exchanger 116(*b*), and a second compressor unit 132, and a controller 134. In some embodiments, the refrigeration system 100 is a transcritical refrigeration system that circulates a working fluid, such as a transcritical refrigerant (e.g., $CO_2$).

System Components

Refrigerant conduit subsystem 102 facilitates the movement of a working fluid (e.g., refrigerant) through a refrigeration cycle such that the working fluid flows as illustrated by arrows in FIG. 1. The refrigerant conduit subsystem 102 includes any conduit, tubing and the like that is illustrated in FIG. 1 fluidly connecting components of the refrigeration system 100.

The first compressor unit 104 is fluidly coupled to the refrigerant conduit subsystem 102. The first compressor unit 104 includes one or more compressors that is configured to compress (i.e., increase the pressure) of the refrigerant. In some embodiments, the first compressor unit 104 is positioned downstream of the first low side heat exchanger unit 116 and the second compressor unit 150. The one or more compressors of the first compressor unit 104 is in signal communication with the controller 134 using wired and/or wireless connection. The controller 134 provides commands and/or signals to control operation of the one or more compressors of the first compressor unit 104. For example, the controller 152 may provide signals to instruct the one or more compressor(s) to operate at a predetermined compressor speed. The one or more compressor(s) of the first compressor unit 104 may vary by design and/or capacity. For example, some compressor designs may be more energy efficient than other compressor designs, and the one or more compressor(s) of the first compressor unit 104 may have modular capacity (e.g., a capability to vary capacity).

The oil separator 106 is fluidly coupled to the refrigerant conduit subsystem 102 and may be located downstream of the first compressor unit 104 and the second compressor unit 132. The oil separator 106 is operable to separate an oil contaminant (e.g., compressor oil) from the refrigerant. The refrigerant exiting the oil separator 106 is provided to the first high side heat exchanger 108, while the oil may be collected and returned to the first compressor unit 104 and the second compressor unit 150, as appropriate.

The first high side heat exchanger 108 is fluidly coupled to the refrigerant conduit subsystem 102. The first high side heat exchanger 108 is positioned downstream from oil separator 106, the first compressor unit 104 and the second compressor unit 150. The first high side heat exchanger 108 is configured to receive refrigerant from the first compressor unit 104 and the second compressor unit 150. The first high side heat exchanger 108 is configured to apply a cooling stage to the received refrigerant. In some embodiments, the first high side heat exchanger 108 is a gas cooler or a condenser. The first high side heat exchanger 108 may comprise cooling coils configured to circulate the received refrigerant, where air is forced across an external surface of the cooling coils. In certain configurations, heat is removed from the refrigerant and transferred to the air surrounding the cooling coils. The first high side heat exchanger 108 may be positioned on a rooftop so that heat removed from the refrigerant may be discharged into the air. In some embodiments, the first high side heat exchanger 108 comprises a fan that transports the air across the outer surface of the coils. The fan may be in communication with the controller 134 (e.g., via wired and/or wireless communication) to receive control signals for turning the fan on, off, and for controlling the speed of the fan to regulate the flow of air across the coils.

The valve 110 is configured to receive refrigerant from the first high side heat exchanger 108 and is fluidly coupled to the refrigerant conduit subsystem 102. The valve 110 may be an expansion valve, a flow control valve (e.g., a thermostatic expansion valve), or any suitable valve that is configured to reduce the pressure of the refrigerant in the refrigerant conduit subsystem 102. The valve 110 may be in communication with controller 134 (e.g., via wired or wireless communication) to receive control signals for opening, closing, and/or to provide flow measurement signals corresponding to flow rate of refrigerant through the valve 110.

The flash tank 112 is fluidly coupled to the refrigerant conduit subsystem 102 and is positioned downstream of the first high side heat exchanger 108. The flash tank 112 is configured to separate the refrigerant into a vapor refrigerant and a liquid refrigerant. Typically, the vapor refrigerant collects near the top of the flash tank 112 and the liquid refrigerant is collected at the bottom of the flash tank 112. In some embodiments, the liquid refrigerant flows from flash tank 112 and provides cooling to the first low side heat exchanger unit 116 and the second low side heat exchanger unit 116(*b*). The flash gas valve 114 may be positioned in the refrigerant conduit subsystem 102 and located in a portion of the refrigerant conduit subsystem 102 that connects the flash tank 112 to the first compressor unit 104. The flash gas valve 114 is configured to open and close to permit or restrict the flow of flash gas discharged from flash tank 112. The controller 134 is in communication with the flash gas valve 114 and controls its operation.

The first low side heat exchanger unit 116 is fluidly coupled to the refrigerant conduit subsystem 102 and is located downstream of the flash tank 112. The first low side heat exchanger unit 116 is configured to receive liquid refrigerant from the flash tank 112 through the refrigerant conduit subsystem 102. The first low side heat exchanger unit 116 is configured to use the refrigerant to provide cooling to a first space proximate to the first low side heat exchanger unit 116. As an example, the first low side heat exchanger unit 116 may be part of a refrigerated case and/or cooler for storing items that should be kept at particular temperatures. The refrigeration system 100 may include any appropriate number of first low side heat exchanger units 116 with the same or a similar configuration to that shown for the example the first low side heat exchanger unit 116 in FIG. 1.

In some embodiments, the first low side heat exchanger unit 116 comprises a first expansion valve 118 positioned upstream of a first low side heat exchanger 120. The first expansion valve 118 is fluidly coupled to the refrigerant conduit subsystem 102 and configured to reduce the pressure of the refrigerant. The first expansion valve 118 may be a flow control valve (e.g., a thermostatic expansion valve valve) or any other suitable valve for reducing pressure from the working fluid while, optionally, providing control of the rate of flow of the refrigerant. The first expansion valve 118 may be in communication with the controller 134 (e.g., via wired and/or wireless communication) to receive control signals for opening and/or closing associated valves and/or provide flow measurement signals corresponding to the rate of refrigerant through the refrigerant conduit subsystem 102.

The first low side heat exchanger 120 is fluidly coupled to the refrigerant conduit subsystem 102 and configured to receive refrigerant from the first expansion valve 118. The first low side heat exchanger 120 is generally any heat exchanger configured to provide heat transfer between the refrigerant flowing through the refrigerant conduit subsystem 102 and airflow passing across an external surface of the first low side heat exchanger 120. The first low side heat exchanger 120 may include one or more circuits of coils 122 configured to circulate the refrigerant received through the first low side heat exchanger 120.

Figure 2:
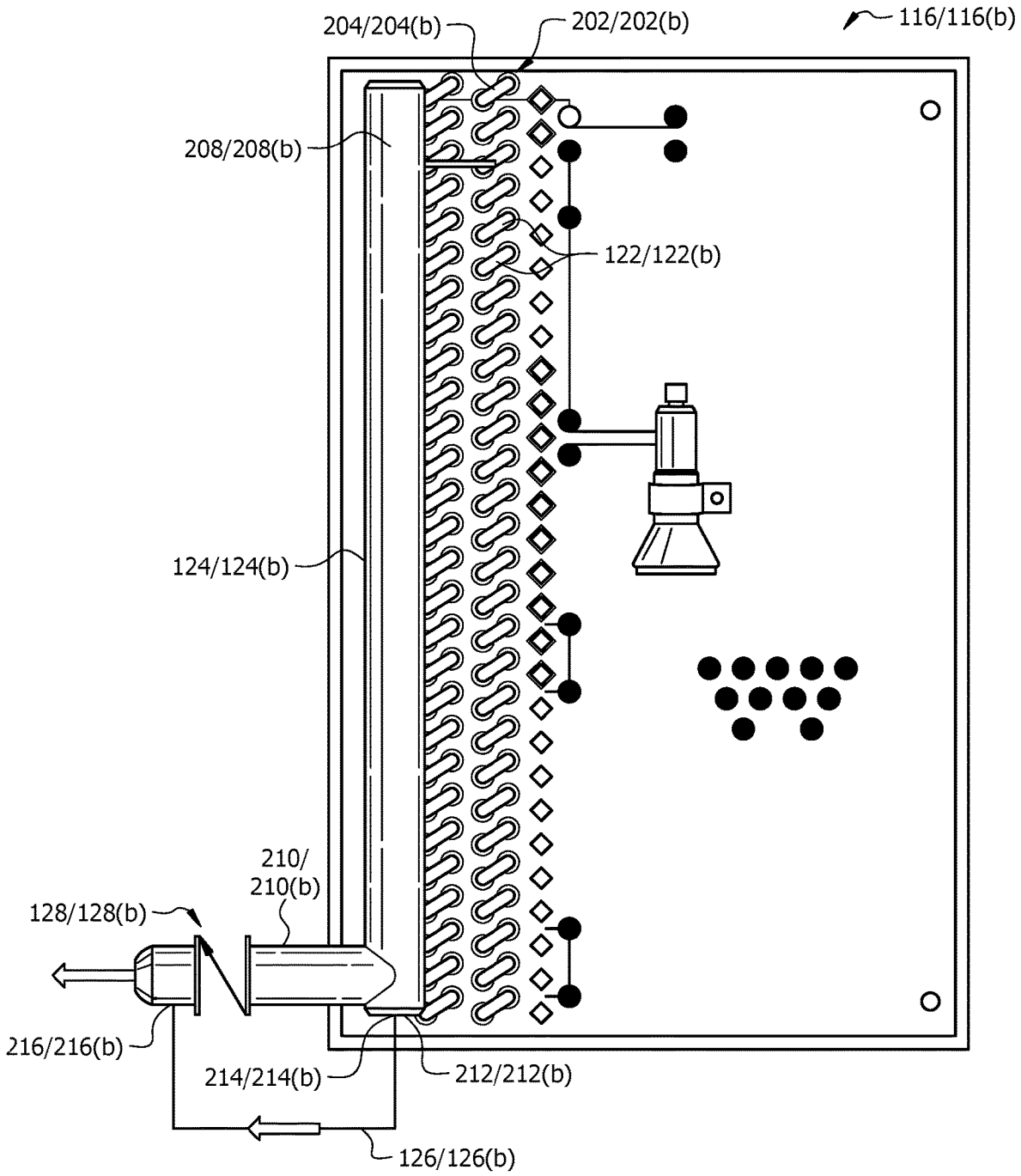
FIG. 2 is a side view illustrating a heat exchanger unit with an oil drain conduit of the refrigeration system of FIG. 1.
Figure 3:
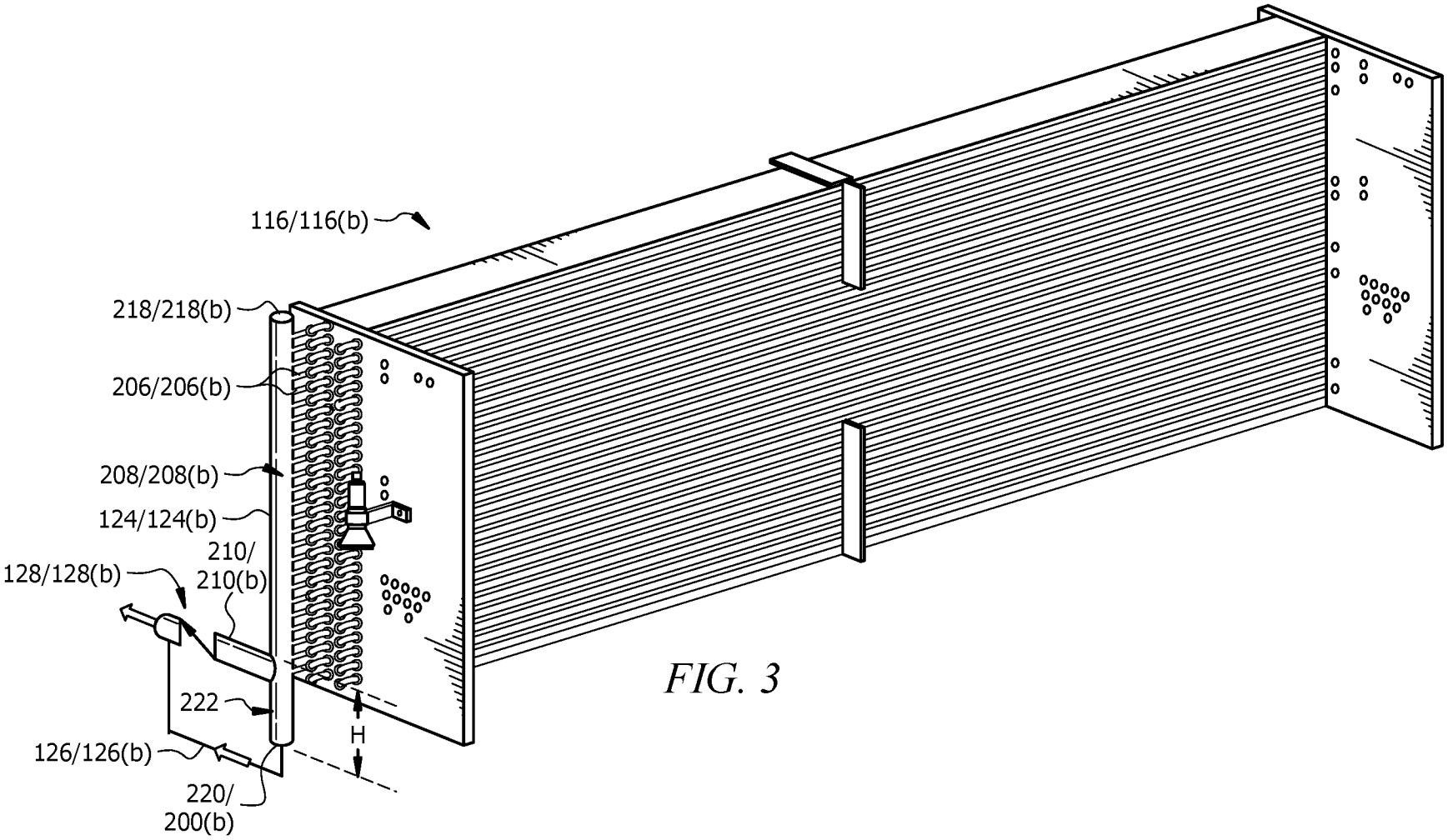
FIG. 3 is a perspective view illustrating the heat exchanger unit with the oil drain conduit of the refrigeration system of FIG. 1.

Referring to FIGS. 2-3, the one or more circuits of coils 122 include a hollow interior 202 configured to receive the refrigerant from the first expansion valve 118. The first low side heat exchanger 120 may act as an evaporator to transfer heat between the airflow passing across an external surface 204 of the one or more circuits of coils 122 and the refrigerant to produce conditioned airflow. The conditioned airflow may then be transferred to the first space proximate the first low side heat exchanger unit 116 to cool the first space. The first low side heat exchanger unit 116 may include a fan to transport airflow across the external surface 204 of the one or more circuits of coils 122. The fan may be in communication with the controller 134 (e.g., via wired and/or wireless communication) to receive control signals for turning the fan on, off and for controlling the speed of the fan to regulate the flow of air across the coils. In some embodiments, the first expansion valve 118 is configured to achieve a refrigerant temperature into the first low side heat exchanger 120 at a predefined temperature for a given application (e.g., about −6° C.).

In some embodiments, a header 124 is positioned downstream of the one or more circuits of coils 122. As shown in FIGS. 2-3, the header 124 includes one or more inlets 206 configured to receive the refrigerant from the one or more circuits of coils 122. The one or more inlets 206 places the hollow interior 202 of the one or more circuits of coils 122 in fluid communication with a hollow interior 208 of the header 124. The header 124 includes a first outlet 210 in fluid communication with the hollow interior 208 of the header 124 and a second outlet 212 in fluid communication with the hollow interior 208 of the header 124. In some embodiments, the second outlet 212 is positioned below the first outlet 210. For example, the header 124 may extend between a top surface 218 and a bottom surface 220. The first outlet 210 may be positioned at a height (H) above the bottom surface 220 of the header 124. A volume between the first outlet 210 and the bottom surface 220 may define an oil collection space 222. The second outlet 212 may be positioned in the oil collection space 222. In some embodiments, the second outlet 212 is positioned on the bottom surface 220 of the header 124. During operation, oil contaminant that is present in the refrigerant may accumulate within the oil collection space 222 of the header 124.

In some embodiments, a check valve 128 is positioned downstream of the first outlet 210 of the header 124. The check valve 128 is configured to allow the refrigerant to flow through the check valve 128 when a pressure difference across the check valve 128 exceeds a threshold pressure. For example, if the pressure difference across the check valve 128 does not exceed the threshold pressure, the check valve 128 will remain in a closed position. If the pressure difference across the check valve 128 exceeds the threshold pressure, the check valve 128 will open and allow the refrigerant to flow through the check valve 128. In some embodiments, the threshold pressure of the check valve 128 may be 0.5 psi to 5 psi.

In some embodiments, an oil drain conduit 126 is positioned downstream of the second outlet 212 of the header 124. The oil drain conduit 126 includes an inlet 214 that is in fluid communication with the second outlet 212 of the header 124. The oil drain conduit 126 includes an outlet 216 that is configured to discharge at least a portion of the refrigerant to a position in the refrigerant conduit subsystem 102 that is downstream of the check valve 128 and upstream of the first compressor unit 104. In some embodiments, the oil drain conduit 126 has a cross-sectional area that is less than a cross-sectional area of the header 124. For example, the cross-sectional area of the header 124 may be at least four times greater than the cross-sectional area of the oil drain conduit 126, or at least five times greater, at least six times greater, to at least seven times greater, or less than nine times greater, or less than ten times greater than the cross-sectional area of the oil drain conduit 126. In one non-limiting example, the diameter of the oil drain conduit 126 is a quarter of an inch.

In some embodiments, the oil drain conduit 126 is sized such that during operation a differential pressure induced by the check valve 128 and a suction pressure from the first compressor unit 104 causes at least a portion of the oil contaminant in the refrigerant to pass from the inlet 214 to the outlet 216 of the oil drain conduit 126. The suction of the refrigerant through the oil drain conduit 126 pulls oil contaminant along with it and reduces an amount of the oil contaminant in the header 124 and the first low side heat exchanger 120, thereby improving operating efficiency and reducing the total energy required to operate the refrigeration system 100. The oil drain conduit 126 may have any suitable geometry, e.g., a U-shape, square, or rectangular geometry.

A valve 130 may be positioned downstream of the check valve 128 and upstream of the first compressor unit 104. The valve 130 may be configured to regulate the flow rate of the refrigerant directed to the first compressor unit 104. In some embodiments, the oil drain conduit 126 is configured to discharge at least a portion of the refrigerant to a position in the refrigerant conduit subsystem 102 that is downstream of the check valve 128 and upstream of the valve 130. The valve 130 may be in communication with the controller 134 (e.g., via wired and/or wireless communication) to receive control signals for opening and/or closing the valve 130 and/or provide flow measurement signals corresponding to the rate of refrigerant through the refrigerant conduit subsystem 102.

The second low side heat exchanger unit 116(*b*) is generally similar to the first low side heat exchanger unit 116 but configured to operate at lower temperatures (e.g., for deep freezing applications near about −30° C. or the like). The second low side heat exchanger unit 116(*b*) is fluidly coupled to the refrigerant conduit subsystem 102 and is located downstream of the flash tank 112. The second low side heat exchanger unit 116(*b*) is configured to receive liquid refrigerant from the flash tank 112 through the refrigerant conduit subsystem 102. The second low side heat exchanger unit 116(*b*) is configured to use the refrigerant to provide cooling to a second space proximate to the second low side heat exchanger unit 116(*b*). As an example the second low side heat exchanger unit 116(*b*) may be part of a refrigerated case and/or cooler for storing items that should be kept at particular temperatures. The refrigeration system 100 may include any appropriate number of second low side heat exchanger units 116(*b*) with the same or a similar configuration to that shown for the example the second low side heat exchanger unit 116(*b*) in FIG. 1.

In some embodiments, the second low side heat exchanger unit 116(*b*) includes a second expansion valve 118(*b*) that is positioned upstream of a second low side heat exchanger 120(*b*). In some embodiments, the second expansion valve 118(*b*) is configured to achieve a refrigerant temperature into the second low side heat exchanger 120(*b*) at a predefined temperature for a given application (e.g., about −30° C.). The second expansion valve 118(*b*) is fluidly coupled to the refrigerant conduit subsystem 102 and configured to reduce the pressure of the refrigerant. The second expansion valve 118(*b*) may be a flow control valve (e.g., a thermostatic expansion valve valve) or any other suitable valve for reducing pressure from the working fluid while, optionally, providing control of the rate of flow of the refrigerant. The second expansion valve 118(*b*) may be in communication with the controller 134 (e.g., via wired and/or wireless communication) to receive control signals for opening and/or closing associated valves and/or provide flow measurement signals corresponding to the rate of refrigerant through the refrigerant conduit subsystem 102.

The second low side heat exchanger 120(*b*) is fluidly coupled to the refrigerant conduit subsystem 102 and configured to receive refrigerant from the second expansion valve 118(*b*). The second low side heat exchanger 120(*b*) is generally any heat exchanger configured to provide heat transfer between the refrigerant flowing through the refrigerant conduit subsystem 102 and airflow passing across an external surface of the second low side heat exchanger 120(*b*). The second low side heat exchanger 120(*b*) may include one or more circuits of coils 122(*b*) configured to circulate the refrigerant received through the second low side heat exchanger 120. The second low side heat exchanger 120(*b*) and the one or more circuits of coils 122(*b*) may have the same or similar configuration to the first low side heat exchanger 120 as described in FIGS. 1-3. The second low side heat exchanger unit 116(*b*) may include a fan to transport airflow across the one or more circuits of coils 122(*b*). The fan may be in communication with the controller 134 (e.g., via wired and/or wireless communication) to receive control signals for turning the fan on, off and for controlling the speed of the fan to regulate the flow of air across the coils.

In some embodiments, a second header 124(*b*) is positioned downstream of the one or more circuits of coils 122(*b*). The second header 124(*b*) has the same or similar configuration to the header 124 described in FIGS. 1-3. As shown in FIGS. 2-3, the second header 124(*b*) includes one or more inlets 206(*b*) configured to receive the refrigerant from the one or more circuits of coils 122(*b*). The one or more inlets 206(*b*) places the hollow interior 202(*b*) of the one or more circuits of coils 122(*b*) in fluid communication with a hollow interior 208 of the second header 124(*b*). The second header 124(*b*) includes a first outlet 210(*b*) in fluid communication with the hollow interior 208(*b*) of the second header 124(*b*) and a second outlet 212(*b*) in fluid communication with the hollow interior 208(*b*) of the second header 124(*b*). In some embodiments, the second outlet 212(*b*) is positioned below the first outlet 210(*b*). For example, the second header 124(*b*) may extend between a top surface 218(*b*) and a bottom surface 220(*b*). The first outlet 210(*b*) may be positioned at a height (H) above the bottom surface 220(*b*) of the second header 124(*b*). A volume between the first outlet 210(*b*) and the bottom surface 220(*b*) may define the oil collection space 222 of the second header 124(*b*). The second outlet 212(*b*) may be positioned in the oil collection space 222. In some embodiments, the second outlet 212(*b*) is positioned on the bottom surface 220(*b*) of the second header 124(*b*). During operation, oil contaminant that is present in the refrigerant may accumulate within the oil collection space 222 of the second header 124(*b*).

In some embodiments, a second check valve 128(*b*) is positioned downstream of the first outlet 210 of the second header 124(*b*). The second check valve 128(*b*) is configured to allow the refrigerant to flow through the second check valve 128(*b*) when a pressure difference across the second check valve 128(*b*) exceeds a threshold pressure. For example, if the pressure difference across the second check valve 128(*b*) does not exceed the threshold pressure, the second check valve 128(*b*) will remain in a closed position. If the pressure difference across the second check valve 128(*b*) exceeds the threshold pressure, the second check valve 128(*b*) will open and allow the refrigerant to flow through the second check valve 128(*b*). In some embodiments, the threshold pressure of the second check valve 128(*b*) may be 0.5 psi to 5 psi.

In some embodiments, a second oil drain conduit 126(*b*) is positioned downstream of the second outlet 212(*b*) of the second header 124(*b*). The second oil drain conduit 126(*b*) includes an inlet 214(*b*) that is in fluid communication with the second outlet 212(*b*) of the second header 124(*b*). The second oil drain conduit 126(*b*) includes an outlet 216(*b*) that is configured to discharge at least a portion of the refrigerant to a position in the refrigerant conduit subsystem 102 that is downstream of the second check valve 128(*b*) and upstream of the second compressor unit 132. In some embodiments, the second oil drain conduit 126(*b*) has a cross-sectional area that is less than a cross-sectional area of the second header 124(*b*). For example, the cross-sectional area of the second header 124(*b*) may be at least four times greater than the cross-sectional area of the second oil drain conduit 126(*b*), or at least five times greater, at least six times greater, to at least seven times greater, or less than nine times greater, or less than ten times greater than the cross-sectional area of the second oil drain conduit 126(*b*). In one non-limiting example, the diameter of the second oil drain conduit 126(*b*) is a quarter of an inch.

In some embodiments, the second oil drain conduit 126(*b*) is sized such that during operation a differential pressure induced by the second check valve 128(*b*) and a suction pressure from the second compressor unit 132 causes at least a portion of the oil contaminant in the refrigerant to pass from the inlet 214(*b*) to the outlet 216(*b*) of the second oil drain conduit 126(*b*). The suction of the refrigerant through the second oil drain conduit 126 pulls oil contaminant along with it and reduces an amount of the oil contaminant in the second header 124(*b*) and the second heat exchanger 120(*b*), thereby improving operating efficiency and reducing the total energy required to operate the refrigeration system 100. The second oil drain conduit 126(*b*) may have any suitable geometry, e.g., a U-shaped, square, or rectangular geometry.

A second valve 130(*b*) may be positioned downstream of the second check valve 128 and upstream of the second compressor unit 132. The second valve 130(*b*) may be configured to regulate the flow rate of the refrigerant directed to the first compressor unit 104. In some embodiments, the second oil drain conduit 126(*b*) is configured to discharge at least a portion of the refrigerant to a position in the refrigerant conduit subsystem 102 that is downstream of the second check valve 128(*b*) and upstream of the second valve 130(*b*). The second valve 130(*b*) may be in communication with the controller 134 (e.g., via wired and/or wireless communication) to receive control signals for opening and/or closing the second valve 130(*b*) and/or provide flow measurement signals corresponding to the rate of refrigerant through the refrigerant conduit subsystem 102.

The second compressor unit 132 is fluidly coupled to the refrigerant conduit subsystem 102. The second compressor unit 132 includes one or more compressors that is configured to compress (i.e., increase the pressure) of the refrigerant. In some embodiments, the second compressor unit 132 is positioned downstream of the second low side heat exchanger unit 116(*b*). The one or more compressors of the second compressor unit 132 is in signal communication with the controller 134 using wired and/or wireless connection. The controller 134 provides commands and/or signals to control operation of the one or more compressors of the second compressor unit 132. For example, the controller 134 may provide signals to instruct the one or more compressor (s) to operate at a predetermined compressor speed. The one or more compressor(s) of the second compressor unit 132 may vary by design and/or capacity. For example, some compressor designs may be more energy efficient than other compressor designs, and the one or more compressor(s) of the second compressor unit 132 may have modular capacity (e.g., a capability to vary capacity).

The controller 134 is in communication with various components in the system including but not limited to: valves 110, 114, 118, 118(*b*), 130, 130(*b*); compressors of the first compressor unit 104 and the second compressor unit 132; fans and/or blowers of the first high side heat exchanger 108, the first low side heat exchanger unit 116, and the second low side heat exchanger unit 116(*b*). The controller 134 includes a processor 136, a network interface circuit 138, and a memory 140. The processor 136 includes one or more processors operably coupled to the memory 140. The processor 136 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 140 and controls the operation of refrigeration system 100. The processor 136 may be a programmable logic device, a microcontroller, a microprocessor, or any suitable combination of the preceding. The processor 136 is communicatively coupled to and in signal communication with the memory 140. The one or more processors are configured to process data and may be implemented in hardware or software. For example, the processor 136 may be 8-bit, 16-bit, 32-bit, 64-bit or of any other suitable architecture. The processor 136 may include an arithmetic logic unit (ALU) for performing arithmetic and logic operations, processor registers that supply operands to the ALU and store the results of ALU operations, and a control unit that fetches instructions from memory 140 and executes them by directing the coordinated operations of the ALU, registers, and other components. The processor 136 may include other hardware and software that operates to process information, control the refrigeration system 100, and perform any of the functions described herein (e.g., with respect to FIGS. 1-4). The processor 136 is not limited to a single processing device and may encompass multiple processing devices. Similarly, the controller 134 is not limited to a single controller but may encompass multiple controllers.

The network interface circuit 138 is configured to communicate data and signals with other devices. For example, the network interface circuit 138 may be configured to communicate electrical signals with the components of the refrigeration system 100. The network interface circuit 138 may be configured to communicate with other devices and systems. The network interface circuit 138 may provide and/or receive, for example, compressor speed signals, compressor on/off signals, valve open/close signals, temperature signals, pressure signals, temperature setpoints, environmental conditions, and an operating mode status for the refrigeration system 100 and send electrical signals to the components of the refrigeration system 100. The network interface circuit 138 may include ports or terminals for establishing signal communications between the controller 134 and other devices. The network interface circuit 138 may be configured to enable wired and/or wireless communications. Suitable network interface circuits 138 include a WIFI interface, a local area network (LAN) interface, a wide area network (WAN) interface, a modem, a switch, or a router. The network interface circuit 138 may be configured to use any suitable type of communication protocol as would be appreciated by one of ordinary skill in the art.

The memory 140 includes one or more disks, tape drives, or solid-state drives, and may be used as an over-flow data storage device, to store programs when such programs are selected for execution, and to store valve instructions 142, compressor instructions 144, and fan and/or blower operating instructions 146 and data that are read during program execution. The memory 166 may be volatile or non-volatile and may include ROM, RAM, ternary content-addressable memory (TCAM), dynamic random-access memory (DRAM), and static random-access memory (SRAM). The memory 140 is operable (or configured) to store information used by the controller 134 and/or any other logic and/or instructions for performing the function described in this disclosure.

Method of Operation

Figure 4:
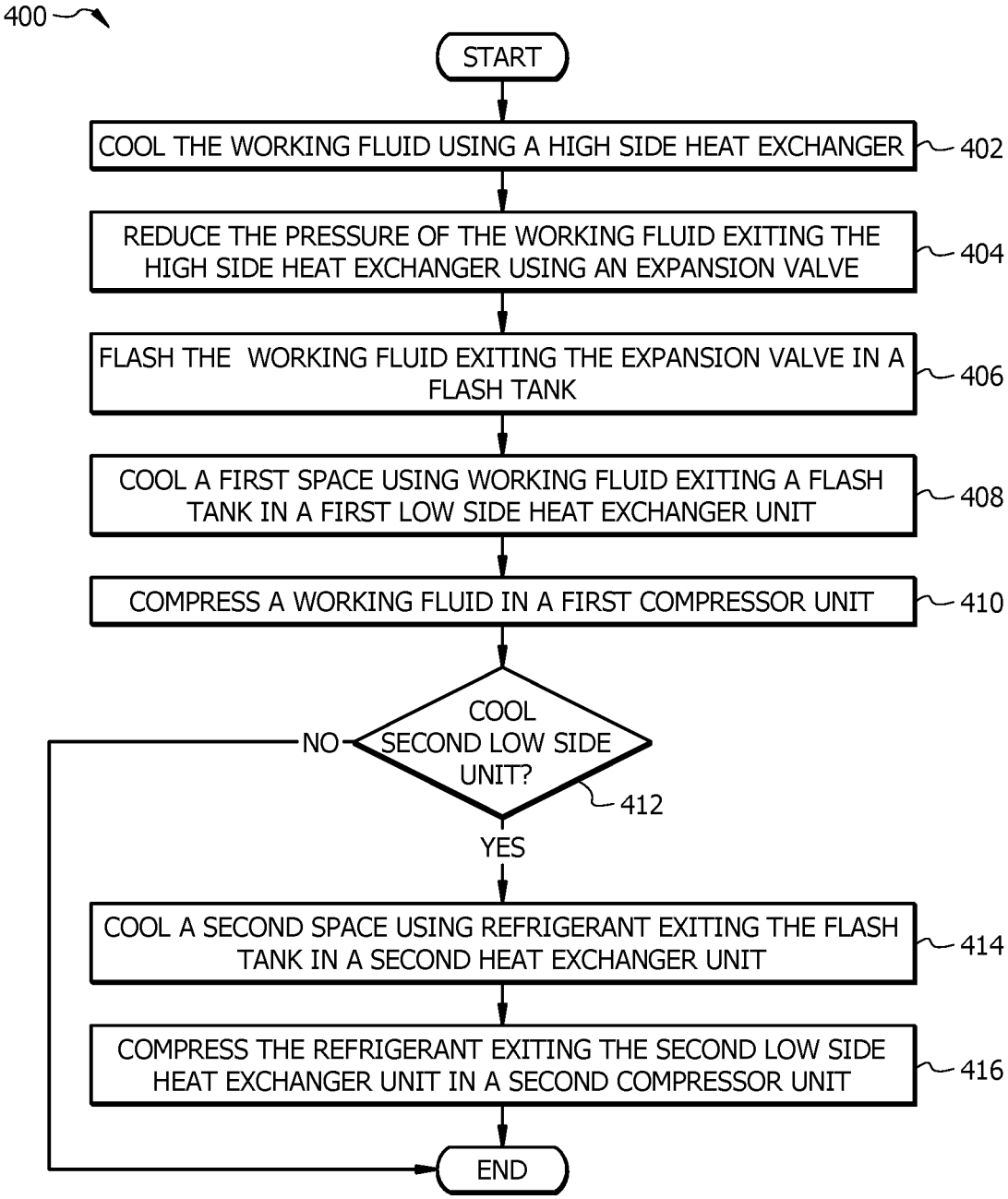
FIG. 4 illustrates a flowchart of one embodiment of a method of operating the system of FIG. 1.

FIG. 4 illustrates an example operational flow 400 for operating the refrigeration system of FIGS. 1-3. The operational flow 400 can logically be described in two parts. The first part includes operations 402-410, which generally includes cooling a working fluid using a first high side heat exchanger 108, reducing the pressure of the working fluid exiting the first high side heat exchanger 108 using a valve 110, flashing the working fluid exiting the expansion valve in a flash tank 112 to generate a liquid refrigerant and a vapor refrigerant, cooling a first space using a portion of the liquid refrigerant exiting the flash tank 112 in a first low side heat exchanger unit 116, and compressing the working fluid exiting the first low side heat exchanger unit 116 in a first compressor unit 104. The second part includes operations 412-416, which generally includes determining whether a cooling demand exists for a second low side heat exchanger unit 116(*b*). If a cooling demand exists, the second part includes cooling a second space using a portion of the liquid refrigerant exiting the flash tank in a second low side heat exchanger unit, and compressing the refrigerant exiting the second low side heat exchanger unit in a second compressor unit.

In operation, the operational flow 400 may begin at operation 402, which includes cooling a working fluid using a first high side heat exchanger 108. For example, the first high side heat exchanger may receive the working fluid from the first compressor unit 104, where the oil separator 106 may optionally reduce an amount of oil contaminant in the working fluid before the first high side heat exchanger 108 receives the working fluid. The first high side heat exchanger 108 is configured to apply a cooling stage to the working fluid received. In some embodiments, the first high side heat exchanger 108 is a gas cooler or a condenser that is configured to transfer heat from the working fluid within the first high side heat exchanger 108 to air that is forced across the first high side heat exchanger 108.

In operation 404, the operational flow 400 includes reducing the pressure of the working fluid exiting the first high side heat exchanger 108 in valve 110. In some embodiments, the valve 110 may be an expansion valve or a flow control valve that is configured to reduce the pressure of the working fluid in the refrigerant conduit subsystem 102.

In operation 406, the operational flow 400 includes flashing the refrigerant exiting the valve 110 in a flash tank 112. The flash tank 112 is configured to separate the refrigerant into a vapor refrigerant and a liquid refrigerant. Typically, the vapor refrigerant collects near the top of the flash tank 112 and the liquid refrigerant is collected at the bottom of the flash tank 112. The flash gas valve 114 may regulate the flow rate of vapor refrigerant exiting the flash tank 112, which is in fluid communication with the first compressor unit 104. In some embodiments, the liquid refrigerant flows from flash tank 112 and provides cooling to the first low side heat exchanger unit 116 and the second low side heat exchanger unit 116(*b*).

In operation 408, the operational flow 400 includes cooling a first space proximate the first low side heat exchanger unit 116. For example, operation 408 may include cooling the first space with the liquid refrigerant exiting the flash tank 112 using the first low side heat exchanger unit 116. To cool the first space, operation 408 may include reducing the pressure of the liquid refrigerant exiting the flash tank 112 in a first expansion valve 118 and cooling the first space by passing the refrigerant through the first low side heat exchanger 120. The first low side heat exchanger 120 may act as an evaporator to transfer heat between the airflow passing across an external surface 204 of the one or more circuits of coils 122 and the refrigerant to produce conditioned airflow. The conditioned airflow may then be transferred to the first space proximate the first low side heat exchanger unit 116 to cool the first space.

During operation 408, the working fluid exiting the first low side heat exchanger 120 is placed in fluid communication with the header 124. The header 124 includes one or more inlets 206 configured to receive the refrigerant from the one or more circuits of coils 122 in the first low side heat exchanger 120. The one or more inlets 206 places the hollow interior 202 of the one or more circuits of coils 122 in fluid communication with a hollow interior 208 of the header 124. The header 124 includes a first outlet 210 and a second outlet 212.

The check valve 128 is positioned downstream of the first outlet 210 of the header 124, and the oil drain conduit 126 is positioned downstream of the second outlet 212 of the header 124. The oil drain conduit 126 includes an inlet that is in communication with the second outlet 212 and an outlet that is configured to discharge at least a portion of the refrigerant and oil contaminant to a position in the refrigerant conduit subsystem 102 that is downstream of the check valve 128 and upstream of the first compressor unit 104. During operation, an oil contaminant that is present in the refrigerant may accumulate towards a bottom surface 220 of the header 124 due to the higher density of the oil contaminant relative to the refrigerant. In some embodiments, the oil drain conduit 126 is sized such that during operation a differential pressure induced by the check valve 128 and a suction pressure from the first compressor unit 104 causes at least a portion of the oil contaminant in the refrigerant to pass from the inlet 214 to the outlet 216 of the oil drain conduit 126. The suction of the refrigerant through the oil drain conduit 126 pulls oil contaminant along with it and reduces an amount of the oil contaminant in the header 124 and the first heat exchanger 120, thereby improving operating efficiency and reducing the total energy required to operate the refrigeration system 100. The operational flow 400 continues to operation 410, which includes compressing the refrigerant exiting the first low side heat exchanger unit 116 using the first compressor unit 104.

At decision block 412, the operational flow 400 includes determining whether a cooling demand exists for the second low side heat exchanger unit 116(*b*). If a cooling demand exists, the operational flow 400 proceeds to operation 414, which includes cooling a second space proximate the second low side heat exchanger unit 116(*b*). For example, operation 412 may include cooling the second space with the liquid refrigerant exiting the flash tank 112 using the second low side heat exchanger unit 116(*b*). To cool the second space, operation 412 may include reducing the pressure of the liquid refrigerant exiting the flash tank 112 in a second expansion valve 118(*b*) and cooling the second space by passing the refrigerant through the second low side heat exchanger 120(*b*). The second low side heat exchanger 120 may act as an evaporator to transfer heat between the airflow passing across an external surface 204(*b*) of the one or more circuits of coils 122(*b*) and the refrigerant to produce conditioned airflow. The conditioned airflow may then be transferred to the second space proximate the second low side heat exchanger unit 116(*b*) to cool the second space.

During operation 408, the working fluid exiting the second low side heat exchanger 120(*b*) is placed in fluid communication with the second header 124(*b*). The second header 124(*b*) includes one or more inlets 206(*b*) configured to receive the refrigerant from the one or more circuits of coils 122(*b*) in the second low side heat exchanger 120(*b*). The one or more inlets 206(*b*) places the hollow interior 202(*b*) of the one or more circuits of coils 122(*b*) in fluid communication with a hollow interior 208(*b*) of the second header 124(*b*). The second header 124(*b*) includes a first outlet 210(*b*) and a second outlet 212(*b*).

The second check valve 128(*b*) is positioned downstream of the first outlet 210(*b*) of the second header 124(*b*), and the second oil drain conduit 126(*b*) is positioned downstream of the second outlet 212(*b*) of the second header 124(*b*). The second oil drain conduit 126(*b*) includes an inlet that is in communication with the second outlet 212(*b*) and an outlet that is configured to discharge at least a portion of the refrigerant and oil contaminant to a position in the refrigerant conduit subsystem 102 that is downstream of the second check valve 128(*b*) and upstream of the second compressor unit 132. During operation, an oil contaminant that is present in the refrigerant may accumulate towards a bottom surface 220(*b*) of the second header 124(*b*) due to the higher density of the oil contaminant relative to the refrigerant. In some embodiments, the second oil drain conduit 126(*b*) is sized such that during operation a differential pressure induced by the second check valve 128(*b*) and a suction pressure from the second compressor unit 132 causes at least a portion of the oil contaminant in the refrigerant to pass from the inlet 214(*b*) to the outlet 216(*b*) of the second oil drain conduit 126(*b*). The suction of the refrigerant through the second oil drain conduit 126(*b*) pulls oil contaminant along with it and reduces an amount of the oil contaminant in the second header 124(*b*) and the second low side heat exchanger 120(*b*), thereby improving operating efficiency and reducing the total energy required to operate the refrigeration system 100. The operational flow 400 continues to operation 416, which includes compressing the refrigerant exiting the second low side heat exchanger unit 116(*b*) using the second compressor unit 132. Once operation 416 is complete, the operational flow 400 may end or may be repeated by re-starting operation 402.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

The invention claimed is:

1. A refrigeration system, comprising:

a low side heat exchanger configured to receive a working fluid, the low side heat exchanger comprising one or more circuits of coils, wherein each of the one or more circuits of coils comprises a hollow interior configured to receive the working fluid, and wherein the one or more circuits of coils are configured to cool a space proximate the low side heat exchanger by transferring heat between airflow passing across an external surface of the one or more circuits of coils and the working fluid passing through the hollow interior of the one or more circuits of coils;

a header positioned downstream of the one or more circuits of coils, the header comprising:

one or more inlets configured to receive the working fluid from the one or more circuits of coils, wherein the one or more inlets places the hollow interior of the one or more circuits of coils in fluid communication with a hollow interior of the header;

a first outlet in fluid communication with the hollow interior of the header; and a second outlet in fluid communication with the hollow interior of the header;

a check valve positioned downstream of the first outlet, wherein the check valve is configured to allow the working fluid to flow through the check valve when a pressure difference across the check valve exceeds a threshold pressure;

a compressor positioned downstream of the check valve, the compressor configured to compress the working fluid received from the check valve; and an oil drain conduit comprising an inlet in fluid communication with the second outlet of the header, the oil drain conduit comprising an outlet configured to discharge at least a portion of the working fluid to a position downstream of the check valve and upstream of the compressor.

2. The refrigeration system of claim 1, wherein the second outlet is positioned below the first outlet.

3. The refrigeration system of claim 1, wherein the header extends between a top surface and a bottom surface, wherein the first outlet in the header is positioned at a height above the bottom surface of the header, wherein a volume between the first outlet and the bottom surface defines an oil collection space.

4. The refrigeration system of claim 3, wherein the second outlet is positioned in the oil collection space.

5. The refrigeration system of claim 3, wherein the second outlet is positioned on the bottom surface of the header.

6. The refrigeration system of claim 1, wherein the oil drain conduit has a cross-sectional area that is less than a cross-sectional area of the header.

7. The refrigeration system of claim 6, wherein the oil drain conduit is sized such that during operation a differential pressure induced by the check valve and a suction pressure from the compressor causes at least a portion of an oil contaminant from the working fluid in the header to pass from the inlet to the outlet of the oil drain conduit.

8. The refrigeration system of claim 1, wherein the oil drain conduit comprises a U-shape.

9. A method of operating a refrigeration system, the method comprising:

reducing a pressure of a working fluid in a first expansion valve;

cooling a first space with the working fluid received from the first expansion valve using a first low side heat exchanger unit, the first low side heat exchanger unit comprising:

a low side heat exchange comprising one or more circuits of coils configured to receive the working fluid from the first expansion valve;

a header comprising one or more inlets configured to receive the working fluid from the one or more circuits of coils, a first outlet, and a second outlet;

a check valve positioned downstream of the first outlet, wherein the check valve allows the working fluid to flow through the check valve when a pressure difference across the check valve exceeds a threshold pressure; and an oil drain conduit comprising an inlet in fluid communication with the second outlet of the header and an outlet that discharges a portion of the working fluid to a position downstream of the check valve; and compressing the working fluid using a compressor, wherein the compressor is positioned downstream of the check valve and the oil drain conduit.

10. The method of claim 9, wherein the second outlet is positioned below the first outlet.

11. The method of claim 9, wherein the header extends between a top surface and a bottom surface, wherein the first outlet in the header is positioned at a height above the bottom surface of the header, wherein a volume between the first outlet and the bottom surface defines an oil collection space.

12. The method of claim 11, wherein the second outlet is positioned on the bottom surface of the header.

13. The method of claim 9, wherein the oil drain conduit has a cross-sectional area that is less than a cross-sectional area of the header.

14. The method of claim 13, wherein the oil drain conduit is sized such that during operation a differential pressure induced by the check valve and a suction pressure from the compressor causes at least a portion of an oil contaminant from the working fluid in the header to pass from the inlet to the outlet of the oil drain conduit.

15. A refrigeration system comprising:

a flash tank comprising a working fluid;

a first low side heat exchanger configured to receive a first portion of the working fluid from the flash tank;

a first header positioned downstream of the first low side heat exchanger, the first header comprising one or more inlets configured to receive the working fluid from the first low side heat exchanger, a first outlet, and a second outlet;

a first check valve positioned downstream of the first outlet;

a first compressor positioned downstream of the first check valve; and a first oil drain conduit comprising an inlet in fluid communication with the second outlet of the first header, the first oil drain conduit comprising an outlet configured to discharge at least a portion of the working fluid to a position downstream of the first check valve and upstream of the first compressor.

16. The refrigeration system of claim 15 further comprising:

a second low side heat exchanger configured to receive a second portion of the working fluid from the flash tank;

a second header positioned downstream of the second low side heat exchanger, the second header comprising one or more inlets configured to receive the working fluid from the second low side heat exchanger, a first outlet of the second header, and a second outlet of the second header;

a second check valve positioned downstream of the first outlet of the second header;

a second compressor positioned downstream of the second check valve; and a second oil drain conduit comprising an inlet in fluid communication with the second outlet of the second header, the second oil drain conduit comprising an outlet configured to discharge at least a portion of the working fluid to a position downstream of the second check valve and upstream of the second compressor.

17. The refrigeration system of claim 15, wherein the second outlet is positioned below the first outlet.

18. The refrigeration system of claim 15, wherein the first header extends between a top surface and a bottom surface, wherein the first outlet in the first header is positioned at a height above the bottom surface of the first header, wherein a volume between the first outlet and the bottom surface defines an oil collection space.

19. The refrigeration system of claim 15, wherein the first oil drain conduit has a cross-sectional area that is less than a cross-sectional area of the first header.

20. The refrigeration system of claim 15, wherein the first oil drain conduit is sized such that during operation a differential pressure induced by the first check valve and a suction pressure from the first compressor causes at least a portion of an oil contaminant from the working fluid in the first header to pass from the inlet to the outlet of the first oil drain conduit.

* * * * *